US007237674B2

(12) United States Patent
Auclair

(10) Patent No.: US 7,237,674 B2
(45) Date of Patent: Jul. 3, 2007

(54) CARTON WITH DISPENSER

(75) Inventor: Jean-Michel Auclair, Chateauroux (FR)

(73) Assignee: MeadWestvaco Packaging Systems, LLC, Glen Allen, VA (US)

( * ) Notice: Subject to any disclaimer, the term of this patent is extended or adjusted under 35 U.S.C. 154(b) by 344 days.

(21) Appl. No.: 10/397,504

(22) Filed: Mar. 26, 2003

(65) Prior Publication Data

US 2004/0188277 A1 Sep. 30, 2004

(51) Int. Cl.
*B65D 75/00* (2006.01)
*B65D 5/00* (2006.01)
*A47F 1/04* (2006.01)

(52) U.S. Cl. ..... 206/427; 206/139; 221/305; 229/122

(58) Field of Classification Search ..... 206/139, 206/170, 199, 193, 434, 427; 221/32, 303, 221/305; 229/122, 122.1, 242
See application file for complete search history.

(56) References Cited

U.S. PATENT DOCUMENTS 1,925,102 A * 9/1933 Levkoff ..... 206/746
3,228,582 A * 1/1966 Osberg ..... 229/242
3,540,581 A * 11/1970 Koolnis ..... 206/193
4,375,258 A * 3/1983 Crayne et al. ..... 206/141
4,396,143 A 8/1983 Killy
4,440,340 A * 4/1984 Bakx ..... 206/155
4,605,128 A * 8/1986 Rieke ..... 229/242
5,482,185 A * 1/1996 McNaughton ..... 221/303
5,881,884 A 3/1999 Podosek
6,283,293 B1 9/2001 Lingamfelter
6,386,369 B2 5/2002 Yuhas et al.
6,534,138 B1 * 3/2003 Jonasson et al. ..... 428/35.5
6,578,736 B2 6/2003 Spivey
2003/0141313 A1 * 7/2003 Bates ..... 221/32
2003/0234285 A1 * 12/2003 Bates et al. ..... 229/244
2004/0089671 A1 * 5/2004 Miller ..... 221/305
2004/0099558 A1 * 5/2004 Oliff et al. ..... 206/427
2004/0155098 A1 * 8/2004 Harrelson ..... 229/122
2004/0188508 A1 * 9/2004 Holley et al. ..... 229/242
2004/0188509 A1 * 9/2004 Holley ..... 229/242

FOREIGN PATENT DOCUMENTS

DE G 85 14 718.4 8/1985
WO 02/47990 A2 6/2002

* cited by examiner

*Primary Examiner*—Mickey Yu
*Assistant Examiner*—J. Gregory Pickett
(74) *Attorney, Agent, or Firm*—Tsugihiko Suzuki

(57) ABSTRACT

A package includes an article group formed of two or more vertically arranged tiers of similarly dimensioned, cylindrical articles disposed on their sides in a side-by-side parallel fashion, and a carton disposed around the group. The carton includes a top wall, opposed side walls, an end wall and an article dispenser. The side walls are disposed alongside the ends of the articles while the end wall is disposed adjacent to the side wall of an endmost article. The dispenser includes a corner portion of the carton formed from and detachably connected to the top, side and end walls to define an opening upon removal of the corner portion. The opening is shaped to define a recess in the end wall to reveal a part of the endmost article in the lowermost tier.

16 Claims, 2 Drawing Sheets

CARTON WITH DISPENSER

BACKGROUND OF THE INVENTION

The invention relates to cartons, and more particularly, to a carton for multiple articles having a dispenser for constrained removal of individual articles. In particular the invention relates to a dispenser, which is adapted to improve access to the articles contained therein.

Cartons for encasing multiple articles are useful for enabling consumers to obtain and transport a desired quantity of individual articles such as soft drinks or other beverages. When such a multiple-pack of articles is obtained, a consumer frequently desires to remove one article from the carton at a time. Thus, it can be appreciated that it would be desirable to have a carton with a dispenser that facilitates the removal of a single article from the carton at a time.

When the articles contained in the carton are cylindrical, and are disposed in the carton upon their sides, it is important that the articles be constrained such that the remaining articles do not roll out of the dispenser when one is removed. It is also important that the dispenser provides a condition where the articles are easily accessed. It is further often desirable when removing individual articles from a carton to be able to determine how many articles remain in the carton. Thus, it can be further appreciated that it would be desirable to have a carton with a dispenser that constrains remaining articles so that they do not undesirably roll from or otherwise exit the carton when one article is removed. It can also be appreciated that it would be desirable to have a carton with a dispenser that facilitates access to the articles. It can be further appreciated that it would be desirable to have a carton with a dispenser that facilitates determining how many articles remain in the carton as individual articles are removed.

It is known to provide a carton having a dispenser for articles, which is provided when part of the carton is substantially detached or torn away from the upper corner of the carton to expose an endmost article for removal.

A problem associated with such known cartons is that a user can have difficulty in grabbing articles from within the carton. The present invention and its preferred embodiments seek to overcome or at least mitigate the problems of the prior art.

SUMMARY OF THE INVENTION

A first aspect of the invention provides a carton comprising a top wall, a pair of opposed side walls, an end wall and an article-dispenser including a removable corner portion defined by severance lines formed respectively in the top wall, the side walls and an end wall. The end wall severance line comprises a first section for defining a recess in the end wall upon removal of the corner portion to reveal a portion of an article packaged in the carton.

Preferably, the end wall severance line extends continuously between the side walls so that an article stopper wall extending continuously between the opposed side walls is formed from the end wall upon removal of the corner portion. Even more preferably, the recess is formed along the upper edge of the stopper wall. Further preferably, the end wall severance line may comprise a second section for defining a retention tab upwardly extending from the stopper wall upon removal of the corner portion.

Even further preferably, the lowest point along the first section is spaced at a first distance above the bottom wall of the carton, the highest point along the second section is spaced at a second distance above the bottom wall, and the lowest point along each of the severance lines in the side walls is spaced at a third distance above the bottom wall. The first distance is less than the third distance while the second distance is greater than the third distance.

A second aspect of the invention provides a package that comprises a carton including an article group formed of at least two vertically arranged tiers of similarly dimensioned, cylindrical articles disposed on their sides in a side-by-side parallel fashion, and a carton disposed around said group. The carton comprises a plurality of walls including a top wall, a pair of opposed side walls connected to the side edges of the top wall, an end wall interconnecting the side walls, a bottom wall interconnecting the lower edges of the side walls, and an article dispenser for dispensing articles from the carton. The dispenser includes a removable corner portion of the carton formed from the top, side and end walls and detachably connected to the top, side and end walls along a detachable connection. An opening for exposing at least some of the articles is defined upon removal of the corner portion. The opening is shaped to define a recess in the end wall to reveal a part of the endmost article in the lowermost tier.

In one class of embodiments, the detachable connection comprises severance lines for defining an edge of the opening. The severance lines may be formed respectively in the top wall, the side walls and the end wall, and the end wall severance line may comprise a first section for defining the recess in the end wall.

According to an optional feature of the second aspect of the invention, the end wall severance line may extend continuously between the side walls so that an article stopper wall is formed from the end wall upon removal of the corner portion.

In a preferred embodiment, the recess is formed along the upper edge of the stopper wall. The end wall severance line may further comprise a second section for defining a retention tab upwardly extending from the stopper wall upon removal of the corner portion.

In another preferred embodiment, the lowest point along the first section is spaced at a first distance above the bottom wall while the highest point along the second section is spaced at a second distance above the bottom wall. The first distance may be less than the diameter of each of the articles, while the second distance may be greater than the diameter of each article. Preferably, the lowest point along each side wall severance line is spaced at a third distance above the bottom wall, and the third distance is greater than the first distance and less than said second distance.

In still another preferred embodiment, the article group is formed of three vertically arranged tiers of articles, and the side wall severance lines are disposed across the opposite ends of the endmost article in the middle tier.

BRIEF DESCRIPTION OF THE DRAWINGS

Exemplary embodiments of the invention will now be described, by way of example only, with reference to the accompanying drawings in which.

DETAILED DESCRIPTION OF THE PREFERRED EMBODIMENT

Figure 1:
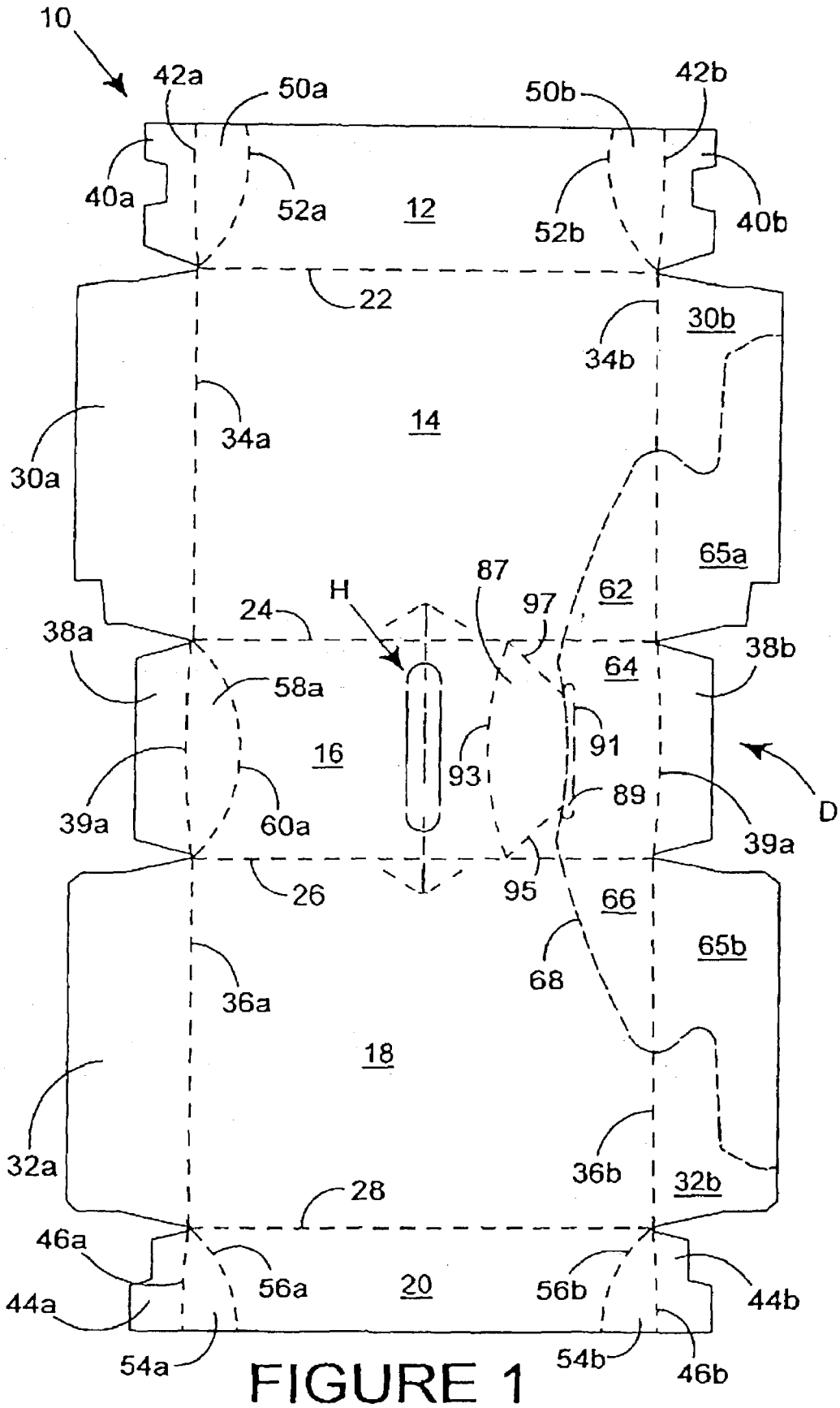
FIG. 1 illustrates a plan view of a blank for forming a carton with a dispenser according to a first embodiment of the invention.

Referring to the drawings, there is shown a carton having a dispenser for dispensing the or each article contained within the carton and a blank for forming the carton. The blank and carton are formed from paperboard or other foldable sheet material, for example plastics material or the like, to which there has been added cut and fold lines. The cartons are used to hold one or more articles, for example cans or bottles, and to dispense the articles. In the illustrated embodiments a unitary blank is used to make a single carton, although it is envisaged that two or more blanks may be employed for example, to provide the dispenser, described in more detail below.

Referring first to FIG. 1, there is shown a blank 10 for forming a carton with a dispenser. The blank 10 comprises in series a first base wall panel 12, a first side wall panel 14, a top wall panel 16, a second side wall panel 18 and a second base wall panel 20 hingedly connected one to the next in series along fold lines 22, 24, 26 and 28 respectively. In use, the first and second base wall panels 12 and 20 are secured together to form a composite bottom wall.

Along each longitudinal edge of the blank, there comprises a series of end wall panels and flaps for forming an end wall of the carton. Each end wall is identical and therefore like references has been used, with the affix "a" or "b". Therefore, only one end will now be described in any greater detail.

The first end wall (the rear end wall) comprises first end wall panel 30*a* hingedly connected to first side wall panel 14 along fold line 34*a* and a second end wall panel 32*a* hingedly connected to the second side wall panel 18 along fold line 36*a*. There further comprises support flaps 40*a*, 38*a* and 44*a* hingedly connected to first base wall panel 12, top wall panel 16 and second base wall panel 20 along fold lines 42*a*, 39*a* and 46*a* respectively. In use, the support flaps 40*a* and 44*a* are secured together to form a composite support flap. The support flaps 40*a*/44*a* and 38*a* are engaged with and support the respective end wall panels 30*a* and 32*a*.

In one class of embodiments, there further comprises beveled panels between the top and end walls and/or the base and end walls such that in FIG. 1, a first part 50*a* of the first beveled panel is positioned intermediate the end support flap 40*a* and base wall panel 12 and hingedly connected thereto along fold lines 42*a* and 52*a*. A second part of the first beveled panel is provided by the panel 54*a* hingedly connected to the second base wall panel 20 and the end support flap 44*a* along fold lines 46*a* and 56*a*. Preferably, there further comprises a second beveled panel 58*a* hingedly interconnecting the top wall panel 16 with the end support flap 38*a* along fold lines 39*a* and 60*a*.

In the embodiment of FIG. 1, the opposed end (front end) comprises a beveled panel formed from first and second parts 50*b*, 54*b* each defined between the respective base wall 12 or 20 and the respective end support flap 40*b* or 44*b*.

A dispenser D is formed at front end of the blank which, in this embodiment, is provided by a removable corner portion T (FIG. 2) comprising a plurality of panels formed from the composite front end wall 40*b*/30*b*/38*b*/32*b*/44*b*, opposed side wall panels 14, 18 and top wall panel 16. In use, a corner portion T is detached from the carton to form the dispenser D shown in FIG. 3.

Figure 2:
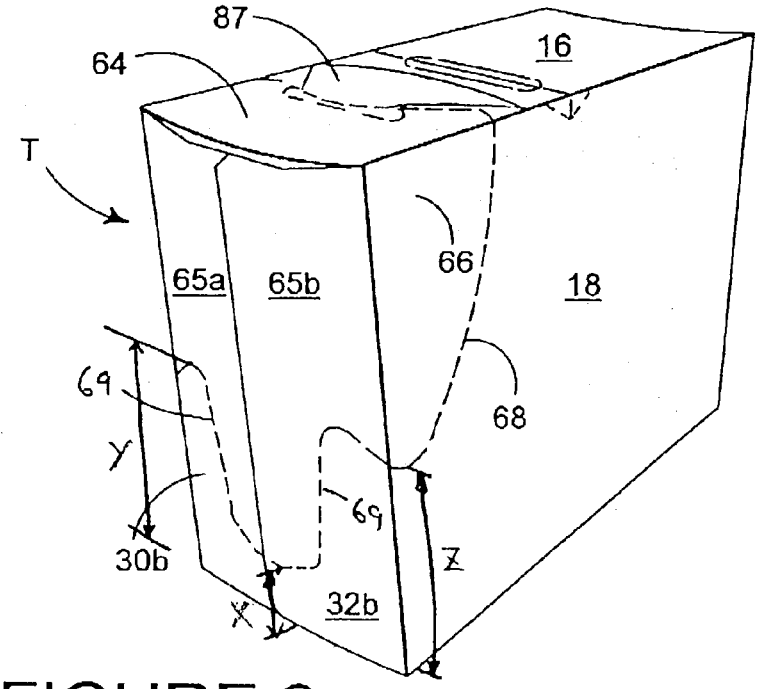
FIG. 2 illustrates a carton formed from the blank shown in FIG. 1.
Figure 3:
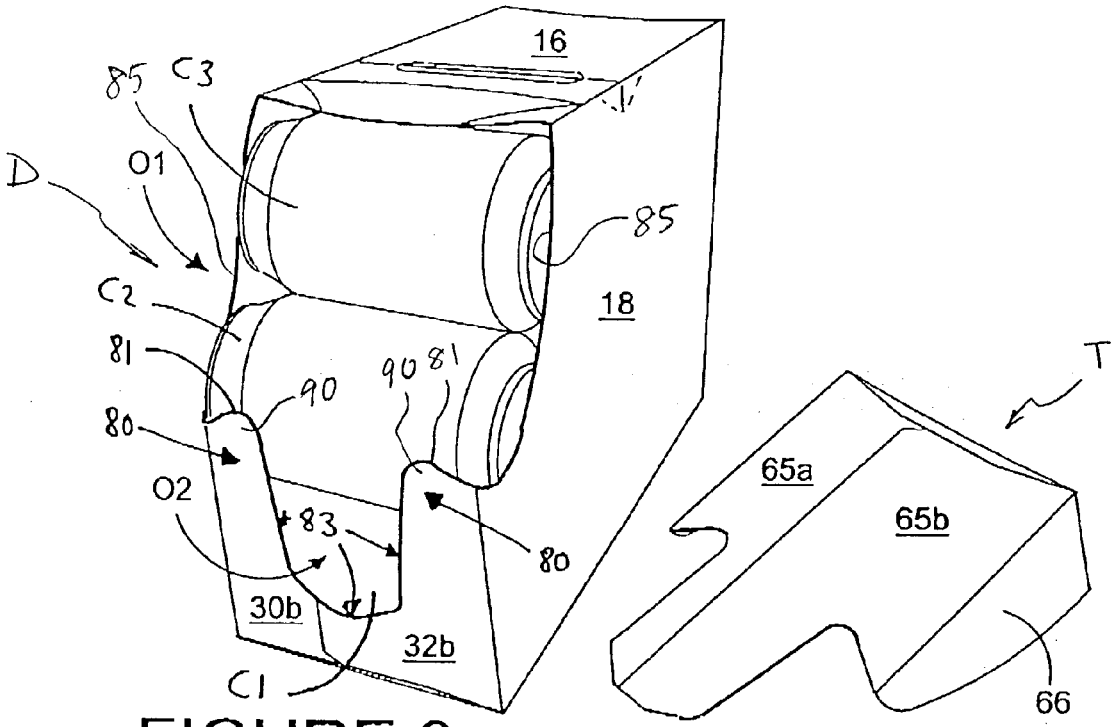
FIG. 3 illustrates the carton with the corner portion removed to reveal the dispenser opening.

Turning to FIGS. 1 and 2, the removable corner portion T comprises a series of panels including a panel 65*a* formed from the end wall panel 30*b*, panels 62, 64, 66 formed from the first side wall panel 14, the top wall panel 16, and the second side wall panel 18 respectively, and a panel 65*b* formed from the end wall panel 32*b*. These panels 65*a*, 62, 64, 66 and 65*b* are frangibly connected respectively to the end wall panel 30*b*, the side and the top wall panels 14, 16, 18 and the end wall panel 32*b* by a detachable connection 68 formed of a series of severance lines. The severance lines are formed respectively in the panels 30*b*, 14, 16, 18, 32*b* and shaped and arranged to define the opening (FIG. 3), which in this embodiment is split into two parts: an upper part O1 and a lower part O2 (FIG. 3).

In the embodiment of FIG. 1, the corner portion T for forming the dispenser is provided with a hand panel 89 (FIG. 1) hingedly connected to panel 64 along fold line 91. Hand panel 89 is frangibly connected to the top panel 16 along the severance line in the top wall panel 16.

There may further comprise a flexing panel 87 hingedly connected to top wall panel 16 along fold lines 93, 95 and 97 to flex when the carton is lifted thereby to reduce the prospect of the carton tearing along detachable connection 68.

It will be seen from FIG. 1 that the blank further comprises a suitable known handle H to allow the user to carry the carton.

In order to form the completed carton in flat collapsed condition from the blank, a series of sequential folding and gluing operations are required and will be described further with reference to FIG. 2. The folding and gluing operations can be performed in one or more straight-line machines so that the blank or carton is not required to be rotated or inverted to complete its construction. The folding process is not limited to that described below and can be altered according to particular manufacturing requirements.

In order to construct an erected carton shown in FIG. 2 from the blank of FIG. 1, the first side wall panel 14 is folded inwardly along fold line 24 to lie flat on top of panels 16 and 18. Glue is applied to first base wall panel 12 and the support flaps 40*a*, 40*b*, and second base wall panel 20 is folded inwardly along fold line 28 to lie flat on first base wall panel 12. By this means, the first and second base wall panels 12, 20 are glued together to form a composite bottom wall 12/20, the support flaps 40*a*, 44*a* are glued together to form a composite bottom end flap 40*a*/44*a*, and the support flaps 40*b*, 44*b* are glued together to form a composite bottom end flap 40*b*/44*b*. This provides a flat tubular carton.

The flat tubular carton is then expanded into an open ended tubular form. Articles, for example cans C, are loaded through one or both of the open ends of the carton and the end walls are formed to close the ends of the carton. As each end wall is substantially the same, the formation of only the rear end wall will hereinafter be described.

First, the bottom end flap 40*a*/44*a* and the support flap 38*a* are folded inwardly along fold lines 42*a*, 39*a* and 46*a* respectively. Thereafter, the end wall panels 30*a*, 32*a* are folded inwardly along fold lines 34*a* and 36*a* respectively and they are secured together by glue or other suitable securing means. Preferably, the flaps 40*a*/44*a* and 38*a* are also secured to the inner surfaces of the end wall panels 30*a* and 32*a* to provide additional support to the end wall panels 30*a* and 32*a*. The opposing end wall (the front wall) is constructed in the same manner, and shall not be described in any further detail.

Thus, the carton is in a completed and closed condition, shown in FIG. 2 in which there is an erected carton. The carton is adapted to hold a group of similarly dimensioned, cylindrical articles (such as cans or bottles), in two or more and preferably three (shown in FIG. 3) vertically arranged tiers. The articles in each tier are disposed on their sides in a side-by-side parallel fashion. The side wall panels 14, 18 are disposed alongside the ends of the articles of the group while each end wall of the carton is disposed adjacent to the side walls of the respective endmost articles.

The removable corner portion T is integrally formed as an end portion of the carton to be displaceable to form the dispenser D.

In order to form the dispenser D, the hand panel 89 is pushed inwardly by folding along fold line 91 and tearing along the detachable connection 68. The user grips a portion of panel 64 and pulls to detach it together with panels 62, 65*a*, 65*b* and 66 from the remainder of the carton to reveal a dispenser opening O1/O2.

When the corner portion T is detached, the lower portion of the front end wall forms a stopper wall 80 that extends upwardly from the composite bottom wall 12/20 between the side wall panels 14 and 18. The upper edge of the stopper wall 80 is defined by the end wall severance line 69 of the detachable connection 68, so that the stopper wall 80 by itself is capable of inhibiting the articles in the lower and middle tiers from inadvertently exiting the carton before intended removal and the contents of the carton are easily viewed through the dispenser opening O1/O2.

The lower part O2 of the opening is a recess defined by a first edge section 83 (FIG. 3), which partially exposes the endmost article C1 in the lowermost tier, so that a user can easily grasp it at its central region. By removing the articles in the uppermost and middle tiers, access is then gained to the lowermost tier. For packages having more than three tiers of articles, the recess is increased in depth by increasing the length of the end wall frangible line 69 in a downward direction. The lowest point along the first edge section 83 is spaced above the bottom wall 12/20 at a first distance X (FIG. 2) that is less than the diameter of each article "C" and is preferably about a half of the diameter of each article.

The lower pan O2 of the opening is a recess defined by a first edge section 83 (FIG. 3), which partially exposes the endmost article C1 in the lowermost tier, so that a user can easily grasp it at its central region. By removing the articles in the uppermost and middle tiers, access is then gained to the lowermost tier. For packages having more than three tiers of articles, the recess is increased in depth by increasing the length of the end wall frangible line 69 in a downward direction. The lowest point along the first edge section 83 is spaced above the bottom wall 12/20 at a first distance X (FIG. 2) that is less than the diameter of each article "C" and is preferably about a half of the diameter of each article. As apparent from FIGS. 2 and 3, the first distance X yet is adequate to allow the upper edge of the lower support flap 40*b*/44*b* to be hidden from view even after the corner portion T is removed.

Each side edge 85 of the upper part O1 that is defined by the respective side wall severance line is shaped to extend across the adjacent end of the endmost article C2 in the middle tier to partially expose the opposite ends of the endmost article C2 as shown in FIG. 3. Preferably, the lowest point along each edge 85 is spaced at a third distance Z (FIG. 2) above the bottom wall 12/20. The third distance Z is greater than the first distance X and less than the second distance Y and is preferably greater than the diameter of each article "C" and less than 1.5 times the diameter of each article, so that a user can easily grasp that the articles in the middle tier. In some embodiments, the curvature of the detachable connection 68 also helps to increase the exposed areas of the article ends to allow the article to be grasped by its opposite ends. After the endmost article is removed from the uppermost tier, the remaining articles C3 in the uppermost tier will nest in the spaces between the articles in the middle tier. Nesting of articles in this manner is well known in the art and is not illustrated.

The present invention and its preferred embodiment relate to an arrangement for providing an article dispenser or access opening in a fully enclosed carton. The invention serves as a useful dispensing carton that can be placed upon a surface or within a compartment such as a refrigerator or pantry. It is anticipated that the invention can be applied to a variety of cartons and is not limited to those cartons for cans or bottles.

It will be recognised that as used herein, directional references such as "top", "base", "bottom", "end", "side", "inner", "outer", "upper", "middle", "lower", "front" and "rear" do not limit the respective panels to such orientation, but merely serve to distinguish these panels from one another. Any reference to hinged connection should not be construed as necessarily referring to a single fold line only; indeed it is envisaged that hinged connection can be formed from one or more of one of the following, a score line, a frangible line or a fold line, without departing from the scope of invention.

It should be understood that various changes may be made within the scope of the present invention, for example, the size and shape of the panels and apertures may be adjusted to accommodate articles of differing size or shape, alternative end wall structures may be used. The carton may accommodate more than one article in different arrays.

The invention claimed is:

1. A package comprising an article group formed of at least two vertically arranged tiers of similarly dimensioned, cylindrical articles each having a diameter, and a carton disposed around said group, the carton comprising a top wall, a pair of opposed side walls, an end wall, a bottom wall, and an article-dispenser including a removable corner portion defined by severance lines formed respectively in the top wall, the side walls and the end wall, wherein the severance line in the end wall extends continuously between the side walls and comprises a first section for defining a recess in the end wall upon removal of the corner portion and a second section extending from the first section to one of the side walls, the lowest point along said first section is spaced at a first distance above said bottom wall, the highest point along said second section is spaced at a second distance above said bottom wall, said first distance is less than said diameter so that an endmost article in a lowermost one of said vertically arranged tiers is exposed to view through said recess upon removal of the corner portion, and said second distance is greater than said diameter so that the end wall is high enough even after removal of the corner portion to retain within the carton an endmost article in a second lowermost one of said vertically arranged tiers.

2. The package as claimed in claim 1 wherein the end wall severance line defines an upper edge of an article stopper wall that is formed from the end wall upon removal of the corner portion, the stopper wall extending continuously between the opposed side walls.

3. The package as claimed in claim 2 wherein the second section is configured to define a retention tab upwardly extending from the stopper wall upon removal of the corner portion.

4. The package as claimed in claim 1 wherein the lowest point along at least one of the severance lines in the side walls is spaced at a third distance above the bottom wall, and the first distance is less than the third distance.

5. The package as claimed in claim 4 wherein the second distance is greater than the third distance.

6. The package as claimed in claim 1 wherein the first section is generally U-shaped to define said recess as well as an complementary projection integral with the corner portion.

7. A package comprising an article group formed of at least two vertically arranged tiers of similarly dimensioned, cylindrical articles disposed on sides thereof in a side-by-side parallel fashion, and a carton disposed around said group, said carton comprising a plurality of walls including a top wall, a pair of opposed side walls connected to side edges of said top wall, an end wall interconnecting said side walls, a bottom wall interconnecting lower edges of said side walls, and an article dispenser for dispensing said articles from said carton, said dispenser including a removable corner portion of said carton formed from said top, side and end walls and detachably connected to said top, side and end walls along a detachable connection to be removed from said carton thereby to define an opening for exposing at least some of said articles, said opening is shaped to define a recess in said end wall to reveal a part of an endmost article in a lowermost tier of said article group and to further define an article stopper wall for retaining an endmost article in a second lowermost tier of said article group, said article stopper wall being formed from said end wall upon removal of said corner portion, wherein said detachable connection comprises severance lines for defining an edge of said opening, said severance lines being formed respectively in said top wall, said side walls and said end wall, and wherein said severance line in said end wall extends continuously between said side walls and comprises a first section for defining said recess in said end wall.

8. The package as claimed in claim 7 wherein each of said articles having an diameter, said end wall severance line further comprises a second section extending from said first section to one of the side walls, the lowest point along said first section is spaced at a first distance above said bottom wall, the highest point along said second section is spaced at a second distance above said bottom wall, said first distance is less than said diameter, and said second distance is greater than said diameter.

9. The package as claimed in claim 8 wherein the lowest point along at least one of the severance lines in the side walls is spaced at a third distance above the bottom wall, and the first distance is less than the third distance.

10. The package as claimed in claim 9 wherein the second distance is greater than the third distance.

11. A package comprising an article group formed of at least two vertically arranged tiers of similarly dimensioned, cylindrical articles disposed on sides thereof in a side-by-side parallel fashion, and a carton disposed around said group, said carton comprising a plurality of walls including a top wall, a pair of opposed side walls connected to side edges of said top wall, an end wall interconnecting said side walls, a bottom wall interconnecting lower edges of said side walls, and an article dispenser for dispensing said articles from said carton, said dispenser including a removable corner portion of said carton formed from said top, side and end walls and detachably connected to said top, side and end walls along a detachable connection to be removed from said carton thereby to define an opening for exposing at least some of said articles, said opening is shaped to define a recess in said end wall to reveal a part of an endmost article in a lowermost tier of said article group, wherein said detachable connection comprises severance lines for defining an edge of said opening, said severance lines being formed respectively in said top wall, said side walls and said end wall, and wherein said severance line in said end wall comprises a first section for defining said recess in said end wall, wherein said end wall severance line extends continuously between said side walls so that an article stopper wall is formed from said end wall upon removal of said corner portion, wherein said recess is formed along an upper edge of said stopper wall, wherein said end wall severance line further comprises a second section for defining a retention tab upwardly extending from said stopper wall upon removal of said corner portion, and wherein the lowest point along said first section is spaced at a first distance above said bottom wall, the highest point along said second section is spaced at a second distance above said bottom wall, said first distance is less than the diameter of each of said articles, and said second distance is greater than the diameter of said each article.

12. The package as claimed in claim 11 wherein the lowest point along each of said severance lines in said side walls is spaced at a third distance above said bottom wall, and said third distance is greater than said first distance and less than said second distance.

13. The package as claimed in claim 12 wherein said article group is formed of three vertically arranged tiers of said articles, and said side wall severance lines are disposed across opposite ends of an endmost article in an middle tier of said article group.

14. A package comprising an article group formed of at least two vertically arranged tiers of similarly dimensioned, cylindrical articles each having a diameter, and a carton disposed around said group, said carton comprising a top wall, a pair of opposed side walls, an end wall and an article-dispenser including a removable corner portion defined by severance lines formed respectively in the top wall, the side walls and the end wall, wherein the severance line in the end wall extends continuously between the side walls, the end wall severance line comprises a generally U-shaped first section for defining a recess in the end wall upon removal of the corner portion and a second section extending from the first section to one of the side walls, the end wall comprises first and second end panels hingedly connected to the side walls respectively, and said first section is formed in part in said first end panel and in part in said second panel, the first section is disposed and dimensioned such that an endmost article in a lowermost one of said vertically arranged tiers is exposed to view through said recess upon removal of the corner portion.

15. The package as claimed in claim 14 wherein said end wall further comprises a lower support flap hingedly connected to a bottom wall of the carton and extending upwardly toward the top wall, the first and second end panels being disposed along an outside surface the lower support flap to cover an upper edge of the lower support flap, wherein the first section is disposed such that upon removal of the corner portion, the upper edge of the lower support flap remains intact and is yet covered by the first and second end panels.

16. The package as claimed in claim 14 further comprising a bottom wall, wherein the lowest point along said first section is spaced at a first distance above said bottom wall, wherein the lowest point along at least one of the severance lines in the side walls is spaced above the bottom wall at a distance greater than said first distance.

* * * * *